US012054870B2

(12) United States Patent
Zattin et al.

(10) Patent No.: US 12,054,870 B2
(45) Date of Patent: Aug. 6, 2024

(54) METHOD FOR WASHING LAUNDRY IN A LAUNDRY WASHING MACHINE AND LAUNDRY WASHING MACHINE IMPLEMENTING THE METHOD

(71) Applicant: Electrolux Appliances Aktiebolag, Stockholm (SE)

(72) Inventors: Andrea Zattin, Porcia (IT); Martino Bondi, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 377 days.

(21) Appl. No.: 17/430,195

(22) PCT Filed: Feb. 27, 2019

(86) PCT No.: PCT/EP2019/054858
§ 371 (c)(1),
(2) Date: Aug. 11, 2021

(87) PCT Pub. No.: WO2020/173560
PCT Pub. Date: Sep. 3, 2020

(65) Prior Publication Data

US 2022/0154378 A1 May 19, 2022

(51) Int. Cl.

| | |
|---|---|
| ***D06F 33/06*** | (2006.01) |
| ***D06F 23/02*** | (2006.01) |
| ***D06F 33/36*** | (2020.01) |
| ***D06F 34/18*** | (2020.01) |
| ***D06F 34/22*** | (2020.01) |

(Continued)

(52) U.S. Cl.
CPC ..... *D06F 33/36* (2020.02); *D06F 23/02* (2013.01); *D06F 34/18* (2020.02); *D06F 34/22* (2020.02); *D06F 39/083* (2013.01); *D06F 2103/02* (2020.02); *D06F 2103/20* (2020.02); *D06F 2105/52* (2020.02)

(58) Field of Classification Search
CPC ..... D06F 39/022
See application file for complete search history.

(56) References Cited

U.S. PATENT DOCUMENTS

| | | | |
|---|---|---|---|
| 1,140,553 | A | 5/1915 | Whittier |
| 1,191,679 | A | 7/1916 | Dziegielewski |

(Continued)

FOREIGN PATENT DOCUMENTS

| | | | |
|---|---|---|---|
| CH | 244295 | A | 9/1946 |
| CN | 101570925 | A | 11/2009 |

(Continued)

OTHER PUBLICATIONS

International Search Report and Written Opinion for International Application No. PCT/EP2019/054857, dated Sep. 18, 2019, 10 pages.

(Continued)

*Primary Examiner* — Jason Y Ko
(74) *Attorney, Agent, or Firm* — Bradley Arant Boult Cummings LLP

(57) ABSTRACT

A method for washing laundry in a laundry washing machine comprising a washing tub external to a washing drum and a turbidity detecting device. The method comprises determining the soil level of the laundry by means of measurement of turbidity through the turbidity detecting device and performing at least one soil removal phase if the soil level is high.

20 Claims, 7 Drawing Sheets

(51) Int. Cl.

| | |
|---|---|
| ***D06F 39/08*** | (2006.01) |
| *D06F 103/02* | (2020.01) |
| *D06F 103/20* | (2020.01) |
| *D06F 105/52* | (2020.01) |

(56) References Cited

U.S. PATENT DOCUMENTS

| | | | |
|---|---|---|---|
| 1,593,372 | A | 7/1926 | Thompson |
| 1,691,724 | A | 11/1928 | Kruschka |
| 1,724,116 | A | 8/1929 | Swearengin |
| 2,317,277 | A | 4/1943 | Knuth |
| 2,453,935 | A | 11/1948 | Quigley et al. |
| 2,507,511 | A | 5/1950 | Freidag et al. |
| 2,677,952 | A | 5/1954 | Stue |
| 2,857,191 | A | 10/1958 | Buchholtz |
| 3,287,043 | A | 11/1966 | Delhase |
| 6,568,719 | B2 | 5/2003 | Buscella |
| 8,104,848 | B2 | 1/2012 | Yoon |
| 8,118,332 | B2 | 2/2012 | Morgan et al. |
| 8,246,089 | B2 | 8/2012 | Mueller et al. |
| 9,120,577 | B1 | 9/2015 | Baic |
| 9,372,001 | B2 | 6/2016 | Gayle et al. |
| 9,410,349 | B2 | 8/2016 | Hapke et al. |
| 9,415,876 | B1 | 8/2016 | Baic |
| 9,745,785 | B2 | 8/2017 | Header |
| 10,023,992 | B2 | 7/2018 | Krieger |
| 2008/0231061 | A1 | 9/2008 | Rocchitelli |
| 2010/0050345 | A1 | 3/2010 | Kim et al. |
| 2018/0002859 | A1 | 1/2018 | Hombroek et al. |
| 2018/0202205 | A1 | 7/2018 | Pychtin |
| 2019/0178014 | A1 | 6/2019 | Gerasimov et al. |

FOREIGN PATENT DOCUMENTS

| | | | |
|---|---|---|---|
| CN | 102199854 | A | 9/2011 |
| CN | 102199856 | A | 9/2011 |
| CN | 105155202 | A | 12/2015 |
| CN | 105177922 | A | 12/2015 |
| CN | 106574419 | A | 4/2017 |
| CN | 107002335 | A | 8/2017 |
| CN | 105088684 | B | 4/2018 |
| CN | 105177923 | B | 4/2018 |
| CN | 109208258 | A | 1/2019 |
| DE | 102006029202 | A1 | 12/2007 |
| EP | 1688529 | A1 | 8/2006 |
| EP | 2194181 | A2 | 6/2010 |
| EP | 2602380 | A1 | 6/2013 |
| EP | 2959819 | A1 | 12/2015 |
| FR | 524921 | A | 9/1921 |
| GB | 18394 | | 1/1914 |
| GB | 418675 | | 10/1934 |
| GB | 607743 | | 9/1948 |
| GB | 990182 | | 4/1965 |
| JP | 2014210123 | A | 11/2014 |
| WO | 2015197109 | A1 | 12/2015 |
| WO | 2016102011 | A1 | 6/2016 |
| WO | 2017033477 | A1 | 3/2017 |
| WO | 2018001072 | A1 | 1/2018 |

OTHER PUBLICATIONS

International Search Report and Written Opinion for International Application No. PCT/EP2019/054858, dated Nov. 7, 2019, 8 pages.

Ives-Glynn Johnson CL21A-US26D Ball Catch, 4-Way, 1 page.

TundraFMP Chg-M22-2430-M22 Heavy Duty 4-Way Door Catch, 1 page.

Chinese Office Action for Chinese Application No. 201980093024.7 dated Apr. 6, 2023, with translation, 22 pages.

Korean Request for the Submission of an Opinion for Korean Application No. 10-2021-7027740, dated Jul. 15, 2023 with translation, 11 pages.

Chinese Office Action for Chinese Application No. 201980092867.5, with English translation, dated Mar. 14, 2023, 24 pages.

METHOD FOR WASHING LAUNDRY IN A LAUNDRY WASHING MACHINE AND LAUNDRY WASHING MACHINE IMPLEMENTING THE METHOD

This application is a U.S. National Phase application of PCT International Application No. PCT/EP2019/054858, filed Feb. 27, 2019, which is incorporated by reference herein.

The present invention concerns the field of laundry washing techniques.

Specifically, the invention relates to a method for washing laundry in a laundry washing machine equipped with a sensor unit.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description, the term "laundry washing machine" will refer to both a simple laundry washing machine and a laundry washing-drying machine.

Laundry washing machines generally comprise an external casing, or cabinet, provided with a washing tub which contains a rotatable perforated washing drum where the laundry is placed. A loading/unloading door ensures access to the washing drum.

Laundry washing machines typically comprise a water supply unit and a treating agents dispenser, preferably equipped with a drawer, for the introduction of water and washing/rinsing products (i.e. detergent, softener, rinse conditioner, etc.) into the washing tub.

Known laundry washing machines are typically provided with a water outlet circuit suitable for withdrawing liquid, for example dirty water, from the bottom of the washing tub to the outside. Laundry washing machines are also typically provided with one or more recirculation circuits.

Water outlet circuit and recirculation circuits are opportunely operated during washing cycle to wash dirty clothes.

Aim of laundry washing machines is to carry out a washing cycle in order to wash clothes in the best way possible.

At this purpose, many laundry washing machines of known type have a soil level feature that allows users to indicate the amount of soil or dirt on clothes to be washed so that the washing cycle may be adjusted accordingly. The soil level is typically selected through selectors/buttons available on the panel of the laundry washing machine, for example thorough the selection among different soil levels indicated as "Light", "Normal" and "Heavy".

Laundry washing machine manufacturers are used to find solutions that are helpful in evaluating the soil levels on clothes in order to carry out the best washing cycle.

It is an object of the present invention to propose a laundry washing machine that improves the control of the soil levels on clothes and performs the proper washing cycle.

It is another object of the present invention to propose a laundry washing machine and a washing cycle that increases cleaning of the soiled clothes compared to known system.

It is a further object of the present invention to propose a laundry washing machine that automatically determines the soil levels on clothes during a washing cycle.

It is another object of the present invention to propose a laundry washing machine and a washing cycle that improves efficiency of the rinse cycle to remove from the clothes the residual detergent and/or dirty particles.

It is a further object of the present invention to propose a laundry washing machine that automatically determines the number of rinsing phases during a rinse cycle.

DISCLOSURE OF INVENTION

Applicant has found that by providing a laundry washing machine comprising a washing tub external to a washing drum and a turbidimeter device and by providing a soil removal phase on the base of values measured through said turbidimeter device, it is possible to reach the mentioned objects.

In a first aspect thereof the present invention relates, therefore, to a method for washing laundry in a laundry washing machine comprising:

- a washing tub external to a washing drum suited to receive the laundry to be washed;
- a water supply system suitable to convey water to said washing tub;
- a treating agents dispenser to supply at least one treating agent into said washing tub, one of said at least one treating agent comprising a detergent;
- a liquid outlet circuit suitable for withdrawing liquid from a bottom region of said washing tub and draining said liquid to the outside;
- a turbidity detecting device that measures the turbidity of the liquid flowing therethrough;

the method comprising the steps of:

- introducing into said washing tub water and said detergent to soak said laundry;
- draining said liquid to the outside through said liquid outlet circuit;

wherein the method comprises the steps of:

- determining, before said draining step, the soil level of said laundry by means of measurement of turbidity through said turbidity detecting device;
- performing at least one soil removal phase, after said draining step, if said soil level is high;
- performing a rinse cycle and a final spinning phase.

In a preferred embodiment of the invention, the soil level is high if the measurement of turbidity is lower than a predetermined threshold.

According to a preferred embodiment of the invention, the method comprises a step of introducing a waiting period before the turbidity measurement so that the liquid is brought in a substantially steady state for the measurement.

Preferably, the at least one soil removal phase comprises introducing water into the washing tub, tumbling the laundry and draining liquid to the outside.

In a preferred embodiment of the invention, the at least one soil removal phase is carried out only if the detergent is a liquid detergent.

According to a preferred embodiment of the invention, the method comprises a step of determining if the detergent is a liquid detergent or a powder detergent.

Preferably, said step of determining if the detergent is a liquid detergent or a powder detergent is based on measurement carried out through an electrical conductivity detecting device.

In a preferred embodiment of the invention, the step of determining if the detergent is a liquid detergent or a powder detergent comprises calculating the difference between the current measured value of conductivity of the liquid containing the detergent and a conductivity reference value which refers to the conductivity of clean water, or substantially clean water, and comparing said difference with a predetermined first threshold.

Preferably, said if said difference is not higher than the predetermined first threshold the detergent is considered to be a liquid detergent.

According to a preferred embodiment of the invention, the method comprises a step of setting said conductivity reference value.

In a further preferred embodiment of the invention, the step of determining if the detergent is a liquid detergent or a powder detergent comprises comparing directly the current measured value of conductivity of the liquid containing the detergent with a predetermined first threshold.

According to a preferred embodiment of the invention, said current measured value of conductivity is not higher than the predetermined first threshold the detergent is considered to be a liquid detergent.

Preferably, the method comprises a step of introducing a waiting period before said conductivity measurement so that the liquid is brought in a substantially steady state.

In a preferred embodiment of the invention, the rinse cycle comprises one or more rinsing phases wherein each rinsing phase comprises adding clean water to the laundry and draining liquid to the outside.

Preferably, the rinse cycle further comprises tumbling the laundry.

According to a preferred embodiment of the invention, said one or more rinsing phases comprise one or more mandatory rinsing phases and one or more additional rinsing phases.

In a preferred embodiment of the invention, the number of said one or more additional rinsing phases is determined on the base of the electrical conductivity measured through an electrical conductivity detecting device.

Preferably, the laundry washing machine further comprises a recirculation circuit apt to drain liquid from the bottom of the washing tub and to re-admit such liquid into a first region of the washing tub and the method further comprises a step of recirculating said liquid from the bottom of the washing tub and re-admitting such liquid into said first region of the washing tub through the recirculation circuit.

According to a preferred embodiment of the invention, the step of determining the soil level of laundry is carried out after the step of recirculating liquid through the recirculation circuit.

In a preferred embodiment of the invention, the turbidity detecting device is arranged along the recirculation circuit and/or the electrical conductivity detecting device is arranged along the recirculation circuit.

In a second aspect thereof, the present invention concerns a laundry washing machine suited to implement the method of the invention described above.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular.

DETAILED DESCRIPTION OF PREFERRED EMBODIMENTS OF THE INVENTION

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

Figure 1:
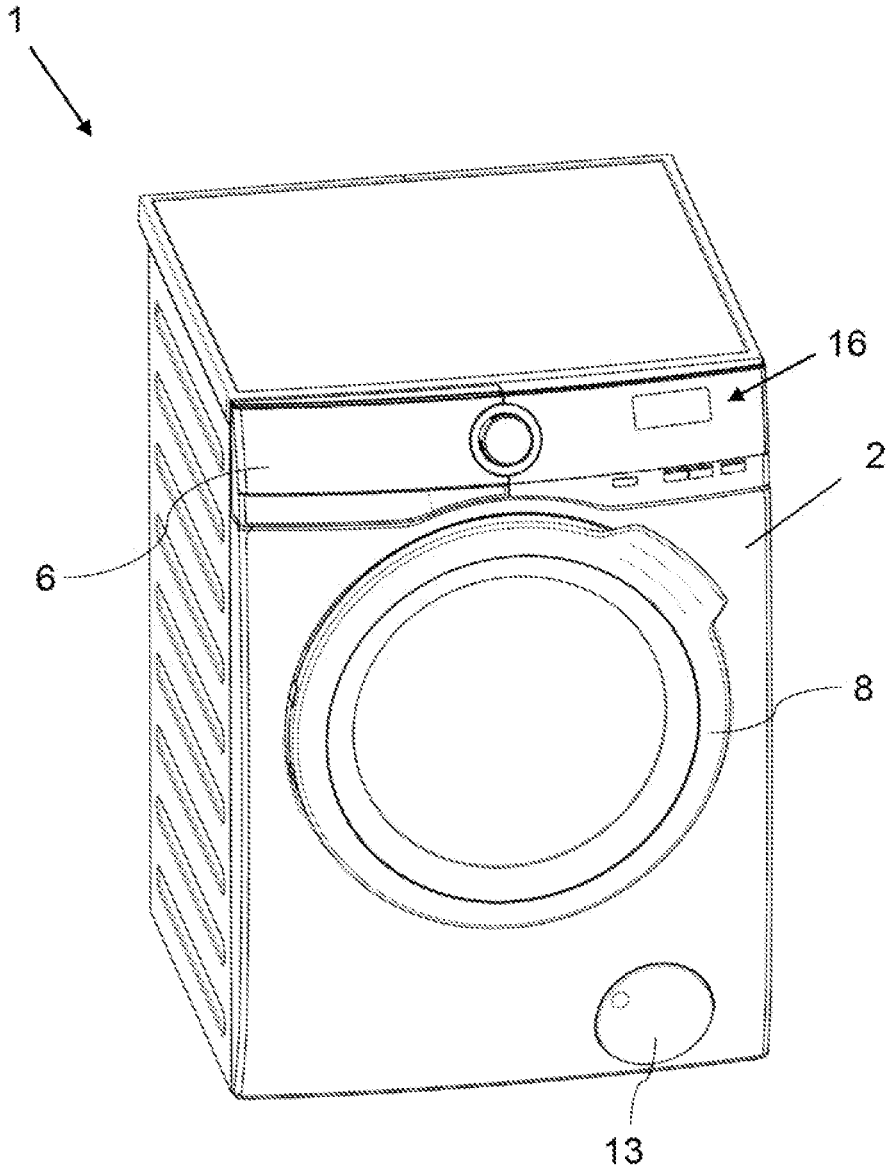
FIG. 1 shows a perspective view of a laundry washing machine where a method according to a first preferred embodiment of the invention is implemented.
Figure 2:
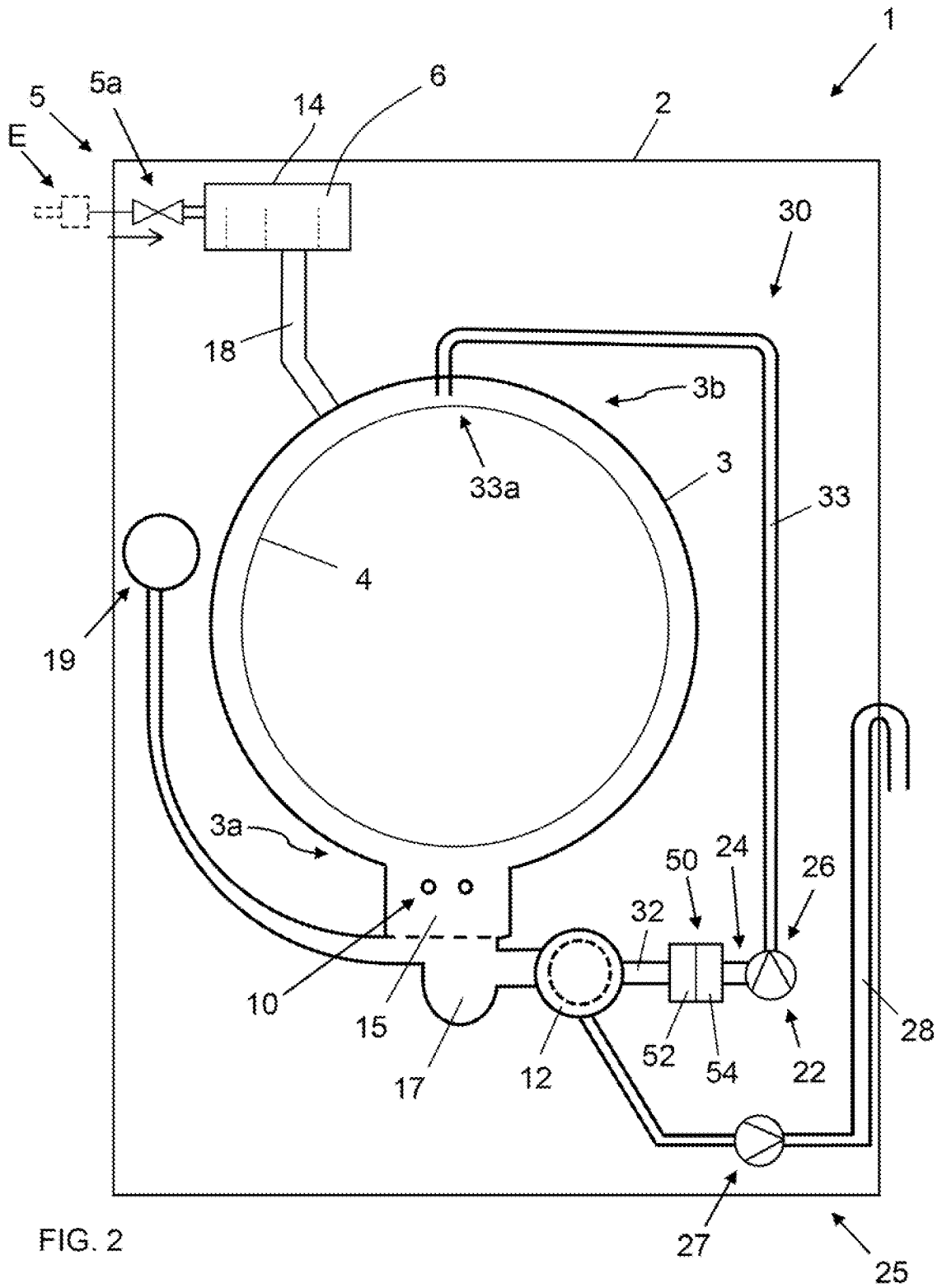
FIG. 2 shows a schematic view of the laundry washing machine of FIG. 1.

With reference to FIGS. 1 and 2 a preferred embodiment of a laundry washing machine 1, in which a method according to a preferred embodiment of the invention is implemented, is shown.

The laundry washing machine 1 preferably comprises an external casing or cabinet 2, a washing tub 3, a container 4, preferably a perforated washing drum 4, where the laundry to be treated can be loaded.

The washing tub 3 and the washing drum 4 both preferably have a substantially cylindrical shape.

The washing tub 3 is preferably connected to the cabinet 2 by means of an elastic bellows, not shown.

The cabinet 2 is provided with a loading/unloading door 8 which allows access to the washing drum 4.

The washing drum 4 is advantageously rotated by an electric motor, not illustrated, which preferably transmits the rotating motion to the shaft of the washing drum 4, advantageously by means of a belt/pulley system. In a different embodiment of the invention, the motor can be directly associated with the shaft of the washing drum 4.

The washing drum 4 is advantageously provided with holes which allow the liquid flowing therethrough. Said holes are typically and preferably homogeneously distributed on the cylindrical side wall of the washing drum 4.

The bottom region 3*a* of the washing tub 3 preferably comprises a seat 15, or sump, suitable for receiving a heating device 10. The heating device 10, when activated, heats the liquid inside the sump 15.

In different embodiments, nevertheless, the bottom region of the washing tub may be configured differently. For example, the bottom region of the washing tub may not comprise a seat for the heating device. The heating device may be advantageously placed in the annular gap between the washing tub and the washing drum.

Preferably, the laundry washing machine 1 comprises a device 19 suited to detect the liquid level inside the washing tub 3.

The sensor device 19 preferably comprises a pressure sensor which senses the pressure in the washing tub 3. From the values sensed by the sensor device 19 it is possible to determine the liquid level of the liquid inside the washing tub 3. In another embodiment, not illustrated, laundry washing machine may preferably comprise (in addition to or as a replacement of the pressure sensor) a level sensor (for example mechanical, electro-mechanical, optical, etc.) adapted to detect the liquid level inside the washing tub 3.

A water supply circuit 5 is preferably arranged in the upper part of the laundry washing machine 1 and is suited to supply water into the washing tub 3 from an external water supply line E. The water supply circuit 5 preferably comprises a controlled supply valve 5*a* which is properly controlled, opened and closed, during the washing cycle. The water supply circuit of a laundry washing machine is well known in the art, and therefore it will not be described in detail.

The laundry washing machine 1 advantageously comprises a treating agents dispenser 14 to supply one or more treating agents into the washing tub 3 during a washing cycle. Treating agents may comprise, for example, detergents D, rinse additives, fabric softeners or fabric conditioners, waterproofing agents, fabric enhancers, rinse sanitization additives, chlorine-based additives, etc.

Preferably, the treating agents dispenser 14 comprises a removable drawer 6 provided with various compartments suited to be filled with treating agents.

In a preferred embodiment, not illustrated, the treating agents dispenser may comprise a pump suitable to convey one or more of said agents from the dispenser to the washing tub.

In the preferred embodiment here illustrated, the water is supplied into the washing tub 3 from the water supply circuit 5 by making it flow through the treating agents dispenser 14 and then through a supply pipe 18.

In an alternative embodiment of the invention, a further separate water supply pipe can be provided, which supplies exclusively clean water into the washing tub from the external water supply line.

Laundry washing machine 1 preferably comprises a water outlet circuit 25 suitable for withdrawing liquid from the bottom region 3*a* of the washing tub 3.

The water outlet circuit 25 preferably comprises a main pipe 17, a draining pump 27 and an outlet pipe 28 ending outside the cabinet 2.

The water outlet circuit 25 preferably further comprises a filtering device 12 arranged between the main pipe 17 and the draining pump 27. The filtering device 12 is adapted to retain all the undesirable bodies (for example buttons that have come off the laundry, coins erroneously introduced into the laundry washing machine, etc.). The filtering device 12 can preferably be removed, and then cleaned, through a gate 13 placed advantageously on the front wall of the cabinet 2 of the laundry washing machine 1, as illustrated in FIG. 1.

The main pipe 17 connects the bottom region 3*a* of the washing tub 3 to the filtering device 12.

In a further embodiment, not illustrated, the filtering device 12 may be provided directly in the washing tub 3, preferably obtained in a single piece construction with the latter. In this case, the filtering device 12 is fluidly connected to the outlet of the washing tub 3, in such a way that water and washing liquid drained from the washing tub 3 enters the filtering device 12.

Activation of the draining pump 27 drains the liquid, i.e. dirty water or water mixed with washing and/or rinsing products, from the washing tub 3 to the outside.

The laundry washing machine 1 preferably comprises a recirculation circuit 30 which is adapted to drain liquid from the bottom region 3*a* of the washing tub 3 and to re-admit such a liquid into a first region 3*b* of the washing tub 3, as better described below.

Preferably, the first region 3*b* of the washing tub 3 substantially corresponds to an upper region 3*b* of the washing tub 3. The liquid is preferably re-admitted to the upper region 3*b* of the washing tub 3 in order to improve wetting/soaking of the laundry inside the washing drum 4.

This action is preferably carried out at the beginning of the washing cycle when the laundry needs to be completely soaked. Furthermore, this action is also preferably carried out during rinsing phases in successive steps of the washing cycle.

The recirculation circuit 30 preferably comprises a first duct 33 terminating at said first region 3*b*, preferably ending at the bellows. The first duct 33 is preferably provided with a terminal nozzle 33*a*.

The recirculation circuit 30 preferably comprises a recirculation pump 22 having an outlet 26 connected to the first duct 33.

The recirculation pump 22 preferably comprises a pump chamber, not shown, having an inlet 24 connected to the bottom 3*a* of the washing tub 3. Inlet 24 of the recirculation pump 22 is preferably connected to the bottom 3*a* of the washing tub 3 through a suction pipe 32 preferably connected to the filtering device 12.

The pump chamber of the recirculation pump 22 then communicates with the outlet 26 for conveying liquid, as said above, to the first duct 33.

Laundry washing machine 1 advantageously comprises an interface unit 16, connected to a control unit, accessible to the user and by means of which the user may select and set the washing parameters, like for example a desired washing cycle. Usually, other parameters can optionally be inserted by the user, for example the washing temperature, the spinning speed, the load in terms of weight of the laundry to be washed, etc.

Based on the parameters acquired by said interface unit 16, the control unit sets and controls the various parts of the laundry washing machine 1 in order to carry out the desired washing program.

According to an advantageous aspect of the invention, the laundry washing machine 1 preferably comprises a sensor unit 50.

The sensor unit 50 is preferably arranged along the suction pipe 32 of the recirculation circuit 30, more preferably at the inlet 24 of the recirculation pump 22.

In a preferred embodiment, the sensor unit 50 preferably comprises a turbidity detecting device 52, in the following simple indicated as "turbidimeter", and preferably also an electrical conductivity detecting device 54, in the following simple indicated as "EC meter".

The turbidimeter 52 preferably comprises an optical turbidimeter that measures the turbidity of the liquid flowing through the suction pipe 32. In a preferred embodiment of the invention the turbidimeter 52 preferably comprises a light emitting device and a light receiving device placed in the suction pipe 32. Output of the turbidimeter 52 gives indication of the turbidity of the liquid and variations thereof.

The EC meter 54 preferably measures the conductivity of the liquid flowing through the suction pipe 32. In a preferred embodiment of the invention the EC meter 54 preferably comprises a pair of electrodes in the suction pipe 32 that measures the electrical conductivity between the electrodes. Output of the EC meter 54 gives indication of the conductivity of the liquid and variations thereof.

A first embodiment of the washing method according to the invention is described here below with reference to flow chart of FIG. 3 and FIG. 3A.

Figure 3:
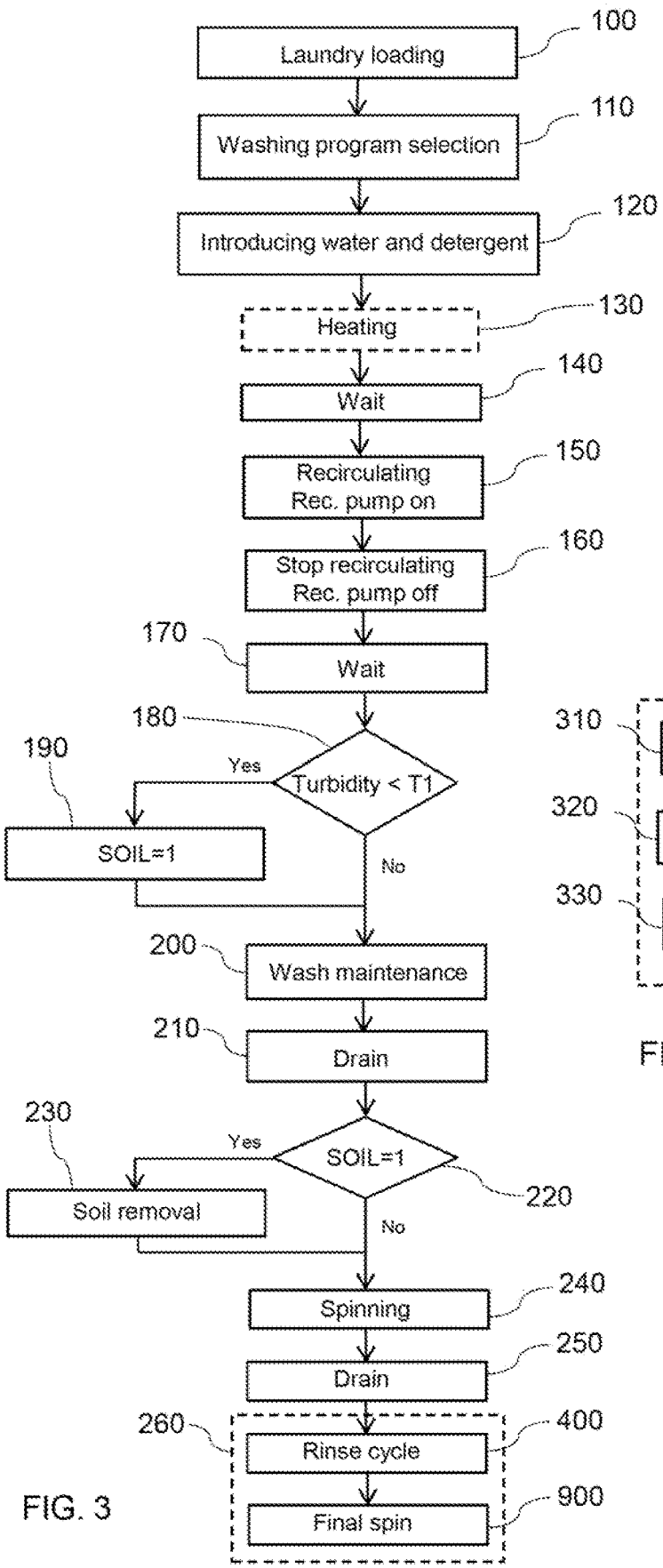
FIG. 3 is a flow chart of the operations of the method for washing laundry in the laundry washing machine of FIG. 1 according to a first preferred embodiment of the invention.

The laundry to be washed is first placed inside the washing drum 4 (block 100 of FIG. 3).

The user fills the compartments of the drawer 6 with the products needed for treatment of the laundry, for example detergent D, softener S, etc.

By operating on the interface unit 16 the user selects the desired washing cycle (block 110). Furthermore, as said above, in a preferred embodiment it is possible for the user to insert some parameters directly by the interface unit 16, for example the value of the washing temperature, the rotating speed of the washing drum 4 in the spinning phase, the duration of the washing cycle, etc.

Once the user has selected the desired washing cycle, the control unit sets the laundry washing machine 1 so that it starts the washing cycle.

In a further embodiment, the selection of the desired washing cycle (block 110) may be performed before placing the laundry into the washing drum 4 (block 100).

In a successive phase (block 120) water and detergent D is introduced into the washing tub 3, preferably making the water flow through the detergent compartment of the treating agents dispenser 14 and then through the supply pipe 18.

The laundry is preferably tumbled by rotation of the washing drum 4 and liquid in the washing tub 3 is preferably heated at a proper temperature by means of the heating device 10 (block 130). In further preferred embodiments, the heating phase (block 130) may be omitted.

In a successive phase the recirculation circuit 30 is preferably activated (block 150), preferably after a waiting time (block 140), for example after 10 seconds.

The recirculation circuit 30 is activated for a predetermined period, for example 14 seconds (block 150), by switching on the recirculation pump 22. Wetting/soaking of the laundry inside the washing drum 4 is thus enhanced.

The recirculation circuit 30 is then deactivated (block 160), by switching off the recirculation pump 22.

As described above, wetting/soaking of the laundry inside the washing drum 4 is preferably obtained through activation of the recirculation circuit 30.

In different embodiments, nevertheless, wetting/soaking of the laundry inside the washing drum 4 may be obtained differently. For example, wetting/soaking of the laundry inside the washing drum 4 may be obtained by introducing a proper quantity of water inside the washing tub 3 so that the water enters the washing drum 4 and wet/soak the laundry. In such a case, the laundry washing machine may be even not equipped with any recirculation circuit.

According to an aspect of the invention, the turbidity of wash liquor used to wet/soak the laundry, i.e. water and detergent D, is detected (block 180), preferably by means of the turbidimeter 52. The liquid turbidity is preferably detected by means of the turbidimeter 52 along the suction pipe 32. In order to enhance measurement of turbidity through the turbidimeter 52 in a substantially steady state of the wash liquor, a waiting period (block 170) is preferably introduced before measurement, for example 30 seconds.

According to the invention, the measured turbidity is compared with a predetermined threshold T1 (comparing block 180) to determine if the laundry is excessively soiled and to set a corresponding soil level parameter "SOIL" (block 190).

Preferably, if the measured turbidity is lower than the predetermined threshold T1 (block 180), then the laundry is considered excessively soiled and the parameter SOIL is set to 1 (block 190).

More preferably, if the measured turbidity is lower than 40% with respect to the value measured through the clean water, then the laundry is considered excessively soiled and the parameter SOIL is set to 1 (block 190). Here, the predetermined threshold T1 is preferably defined as a percentage with respect to the ideal situation in which totally clean water flows through the turbidimeter 52. In a preferred embodiment of the invention, therefore, the turbidimeter 52 is advantageously calibrated in advance by the manufacturer so that its measurement for totally clean water corresponds to value 100. Any measured value lower than 100 gives an indication of turbidity, the lower is the measured value the higher is the turbidity.

It has to be noted that the parameter SOIL is set to 0 before the comparing block 180. Preferably, the parameter SOIL is automatically set to 0 at the beginning of the washing cycle.

The predetermined threshold T1 is preferably determined by experimental trials.

Once the soil level determination of the wash liquor has been completed, a washing maintenance phase is preferably performed (block 200).

In this phase the laundry is preferably tumbled by rotation of the washing drum 4 for a predetermined maintenance time so that the laundry is subject to mechanical action and the detergent D has time to react with the dirty laundry.

At the end of the maintenance phase (block 200), the wash liquor is drained to the outside by activating the draining pump 27 of the water outlet circuit 25 (block 210).

After the draining phase (block 210) and according to an aspect of the invention, the method preferably performs a soil removal phase (block 230) if the laundry has been previously considered excessively soiled.

In particular, if the parameter SOIL is equal to 1 (exit branch "Yes" of block 220), the soil removal phase is performed (block 230).

Figure 3A:
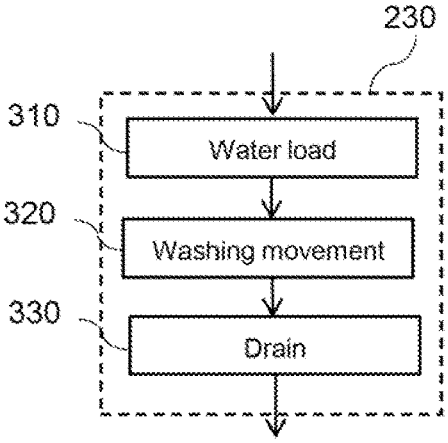
FIG. 3A shows operations of a processing step of the flow chart of FIG. 3 according to a preferred embodiment of the invention.

The soil removal phase (block 230) according to a preferred embodiment of the invention is shown in FIG. 3A.

The soil removal phase (block 230) preferably comprises a water load step (block 310) wherein clean water is introduced into the washing tub 3 by the water supply circuit 5, a washing movement phase (block 320) wherein the laundry is preferably tumbled by rotation of the washing drum 4 and subject to mechanical action and a draining phase (block 330) wherein the wash liquor is preferably drained to the outside by activating the draining pump 27 of the water outlet circuit 25.

In different preferred embodiments, the soil removal phase may comprise a plurality of washing movement phases and/or a plurality of draining phases.

According to an advantageous aspect of the invention, the soil removal phase (block 230) increases cleaning of the soiled laundry. Furthermore, and according to a further advantageous aspect of the invention, the soil removal phase (block 230) is performed after the high-level soil of the wash liquor has been automatically determined through the turbidimeter 52 (block 180).

In a successive step of the method, the washing cycle preferably comprises a spinning phase to extract wash liquor from the laundry (block 240) and a draining phase for draining the wash liquor to the outside by activating the draining pump 27 of the water outlet circuit 25 (block 250).

The washing cycle then preferably proceeds with further phases, globally indicated with block 260, to terminate the washing cycle. Such phases preferably comprise a rinse cycle (block 400) and a final spinning phase (block 900).

The rinse cycle preferably comprises one or more rinsing phases wherein clean water is added to the laundry to be absorbed by the laundry. The clean water removes from the laundry the residual detergent D and/or dirty particles. The washing drum 4 is preferably rotated to extract water and dirty particles/detergent from the laundry: the dirty water extracted is drained from the washing tub 3 to the outside preferably by activating the draining pump 27 of the water outlet circuit 25.

In the final spinning phase, the washing drum 4 is preferably rotated at high speed (for example about 800-1500 rpm) to obtain the extraction of the water from the laundry. At the same time, the draining pump 27 is activated to drain the liquid from the washing tub 3 to the outside through the outlet pipe 28.

The washing method, or washing cycle, above described according to a preferred embodiment of the invention is preferably carried out irrespective of the type of detergent D used.

Nevertheless, the method is particularly effective when the detergent is a liquid detergent. In case a powder detergent is used, the turbidity of the liquid is negatively affected by the powder detergent itself and therefore the turbidity measurement may not be actually the indication of the soil level of wash liquor.

Figure 4:
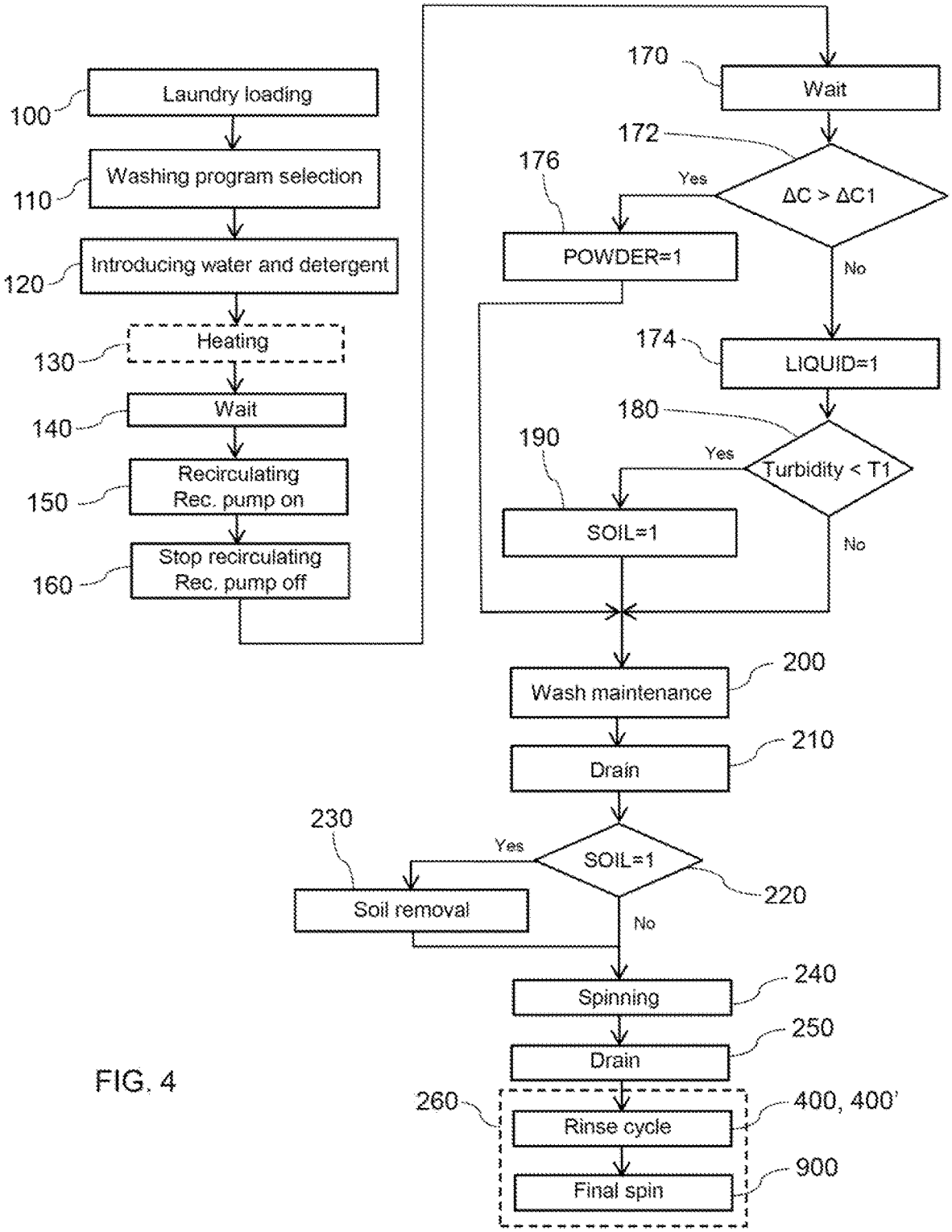
FIG. 4 is a flow chart of the operations of the method for washing laundry in the laundry washing machine of FIG. 1 according to a second preferred embodiment of the invention.

FIG. 4 shows the flow chart of a further embodiment of the washing cycle according to the invention that faces this inconvenient.

The method according to the flow chart of FIG. 4 differs from the method previously described with reference to FIGS. 3 and 3A in that determination of the soil level of the wash liquor (blocks 180 and 190) is carried out only if the detergent used is a liquid detergent.

Determination of the type of detergent used is preferably based on measurements obtained from the EC meter 54.

Preferably, determination of the soil level of the wash liquor and respective removal phase is carried out only if it is determined that the detergent is a liquid detergent. Conversely, if it is determined that the detergent is a power detergent, the soil level of the wash liquor and hence the removal phase is not considered.

In the flow chart of FIG. 4, blocks having the same reference numbers of the flow chart of FIG. 3 identify the same features as previously described.

The method therefore preferably comprises the above described steps of:

- placing laundry inside the washing drum 4 (block 100);
- filling the compartments of the drawer 6 with the products needed for treatment of the laundry, for example liquid or powder detergent D, softener S, etc.;
- selecting the desired washing cycle (block 110);
- introducing water and detergent D into the washing tub 3 (block 120);
- optionally heating the wash liquor in the washing tub 3 (block 130);
- waiting some seconds (block 140);
- activating the recirculation circuit 30 (block 150) for a predetermined period and deactivating the recirculation circuit 30 (block 160);
- waiting some seconds so that wash liquor is brought to a substantially steady state (block 170).

According to the variant embodiment here described, the type of detergent used to wash the laundry, i.e. liquid or powder, is determined (block 172). The type of detergent is preferably determined on the base of the values of the liquid conductivity measured by the EC meter 54.

The liquid conductivity is preferably measured by means of the EC meter 54 along the suction pipe 32.

According to the invention, the current measured value of conductivity Cc is used to determine if the detergent is a liquid detergent or a powder detergent (comparing block 172).

Preferably, the current measured value of conductivity Cc is used to determine if the detergent is a liquid detergent or a powder detergent by comparing it with a first threshold $\Delta C1$ (comparing block 172).

In the preferred embodiments of the invention hereinafter described, the comparison is not carried out using directly the current measured value of conductivity Cc but rather using the parameter $\Delta C = Cc - C0$, wherein C0 is a water conductivity reference value which refers to the conductivity of the clean water, also indicate as the parameter ZeroConductivity. The value of the parameter ZeroConductivity C0 is preferably set in a phase of the washing cycle wherein the liquid inside the washing tub 3 may be considered clean, or substantially clean, as better described later.

Throughout the description, therefore, the parameter $\Delta C = Cc - C0$ is always preferably used to carry out comparisons with predetermined thresholds. In different preferred embodiments, nevertheless, current measured value of conductivity Cc could be directly used for the comparison with predetermined ad hoc thresholds.

Preferably, therefore, in block 172 the difference $\Delta C$ between the current measured value of conductivity Cc and the ZeroConductivity value C0, i.e. $\Delta C = Cc - C0$, is compared with a predetermined first threshold $\Delta C1$ to determine if the detergent is a liquid detergent or a powder detergent.

Preferably, if $\Delta C$ is not higher than the predetermined first threshold $\Delta C1$ (output "No" of block 172), for example not higher than $\Delta C1 = 500$ μS/cm, the detergent is considered to be a liquid detergent and a parameter LIQUID is preferably set to 1 (block 174).

The parameter LIQUID is set to 0 before the comparing block 172. Preferably, the parameter LIQUID is automatically set to 0 at the beginning of the washing cycle.

The parameter LIQUID is advantageously used in further preferred embodiments of the invention, as better described later.

In a further preferred embodiment, the parameter LIQUID is not used and the block 174 may therefore be absent.

If it has been determined that the detergent used is a liquid detergent then determination of the soil level of the wash liquor is carried out (blocks 180 and 190) and the method will proceed with remaining phases, preferably a washing maintenance phase (block 200), a draining phase (block 210), a removal phase if necessary (block 230), a spinning phase (block 240), a draining phase (block 250) and final phases (block 260). Final phases (block 260) preferably comprise a rinse cycle (block 400 or 400') and a final spinning phase (block 900).

Preferably, if $\Delta C$ is higher than the predetermined first threshold $\Delta C1$ (output "Yes" of block 172), for example higher than 500 μS/cm, the detergent is considered to be a powder detergent and a parameter POWDER is preferably set to 1 (block 176).

The parameter POWDER is set to 0 before the comparing block 172. Preferably, the parameter POWDER is automatically set to 0 at the beginning of the washing cycle.

The parameter POWDER is advantageously used in further preferred embodiments of the invention, as better described later.

In a further preferred embodiment, the parameter POWDER is not used and the block 176 may therefore be absent.

If it has been determined that the detergent used is a powder detergent then determination of the soil level of the wash liquor is not carried out and the method will proceed with remaining phases, preferably a washing maintenance phase (block 200), a draining phase (block 210), a spinning phase (block 240), a draining phase (block 250) and final phases (block 260). Final phases (block 260) preferably comprise a rinse cycle (block 400 or 400') and a final spinning phase (block 900).

Determination of the detergent type as explained above takes into account the fact that the conductivity of a wash liquor comprising powder detergent is higher than the conductivity of a wash liquor comprising liquid detergent.

Advantageously, according to this embodiment of the invention, it is possible to perform a washing cycle wherein the type of detergent, liquid or powder, is automatically determined by means of the EC meter 54 of the sensor unit 50 and wherein a soil removal phase is automatically performed if the detergent is a liquid detergent and if it is determined that the laundry is soiled by means of the turbidimeter 52 of the sensor unit 50.

Figure 5:
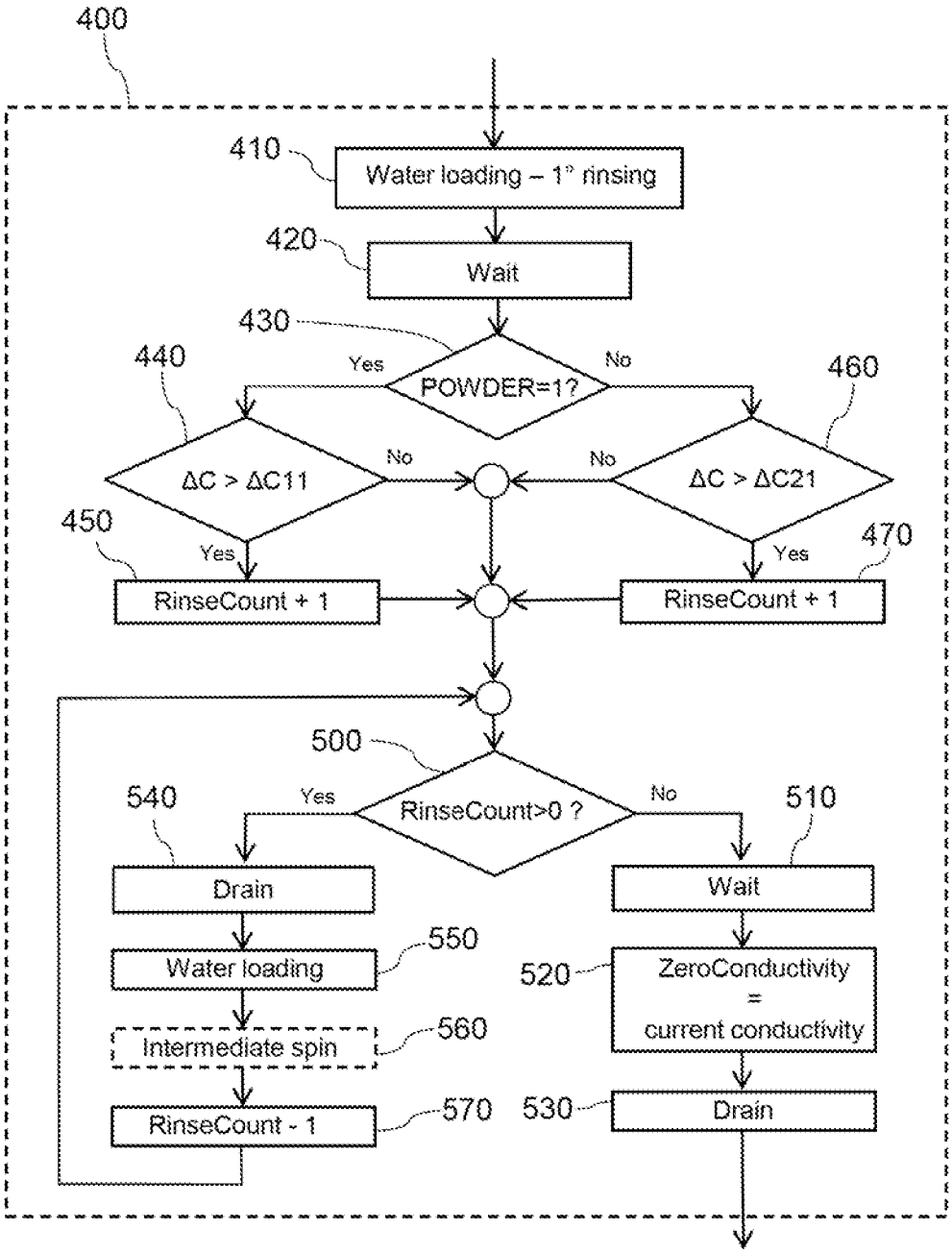
FIG. 5 shows operations of a processing step of the flow chart of FIG. 4 according to a first preferred embodiment of the invention.

FIG. 5 shows a flow chart of a preferred embodiment of the rinse cycle (block 400) of the washing cycle according to the flow chart of FIG. 4.

As known, the rinse cycle preferably comprises one or more rinsing phases wherein clean water is added to the laundry and then drained to the outside to remove from the laundry the residual detergent D and/or dirty particles.

According to an aspect of the invention, the number of rinsing phases after a first mandatory rinsing phase is evaluated automatically according to the values detected by the EC meter 54. Furthermore, evaluation of the values detected by the EC meter 54 depends on the detergent type previously determined through the EC meter 54 or, in other words, the values detected by the EC meter 54 are treated differently if the detergent is a liquid detergent or a powder detergent.

The rinse cycle (block 400) starts with a water loading (block 410) for the first mandatory rinsing phase wherein water is introduced into the washing tub 3.

In a successive step it is checked the type of detergent used (block 430).

Check of the detergent type is carried out by controlling the value of the parameter POWDER previously determined. Namely, if the parameter POWDER is 1 then the detergent is a powder detergent (output "Yes" of block 430) otherwise the detergent is a liquid detergent (output "No" of block 430).

In a different embodiment, check of the detergent type may be analogously carried out by controlling the value of the parameter LIQUID previously determined.

If the detergent is a powder detergent (output "Yes" of block 430), the current measured value of conductivity Cc is compared with the value of ZeroConductivity C0. Preferably, in block 440 the difference $\Delta C = Cc - C0$ between the current measured value of conductivity Cc and the ZeroConductivity value C0 is compared with a predetermined second threshold $\Delta C11$, for example $\Delta C11 = 300$ μS/cm. The second threshold $\Delta C11$ is set lower than the first threshold $\Delta C1$.

Preferably, if $\Delta C$ is higher than the predetermined second threshold $\Delta C11$ (output "Yes" of block 440) then the amount of residual powder detergent D still present in the liquid is considered too high. For this reason, and according to an aspect of the invention, it is considered that the washing cycle will need an additional rinsing phase. At this purpose, the value of a parameter RinseCount is incremented by 1 (block 450).

Throughout the description, the value of the parameter RinseCount indicates the number of additional rinsing phases needed.

The parameter RinseCount is set to 0 before the comparing block 440. Preferably, the parameter RinseCount is automatically set to 0 at the beginning of the washing cycle.

If $\Delta C$ is not higher than the predetermined second threshold $\Delta C11$ (output "No" of block 440) then the amount of residual powder detergent D still present in the liquid is considered acceptable. At this purpose, the value of the parameter RinseCount remains unchanged and therefore it is considered that the washing cycle will not need any additional rinsing phase.

In order to enhance measurement of the conductivity through the EC meter 54 in a substantially steady state of the liquid, a waiting period (block 420) is preferably introduced before measurement, for example 30 seconds.

Analogously, if the detergent is a liquid detergent (output "No" of block 430), the current measured value of conductivity Cc is compared with the value of ZeroConductivity C0. Preferably, in block 460 the difference $\Delta C = Cc - C0$ between the current measured value of conductivity Cc and the ZeroConductivity value C0 is compared with a predetermined third threshold $\Delta C21$, for example $\Delta C21 = 20$ μS/cm. The third threshold $\Delta C21$ is set lower than the first threshold $\Delta C1$.

Preferably, if $\Delta C$ is higher than the predetermined third threshold $\Delta C21$ (output "Yes" of block 460) then the amount of residual liquid detergent D still present in the liquid is considered too high. For this reason, and according to an aspect of the invention, it is considered that the washing cycle will need an additional rinsing phase. At this purpose, the value of the parameter RinseCount is incremented by 1 (block 470).

If $\Delta C$ is not higher than the predetermined third threshold $\Delta C21$ (output "No" of block 460) then the amount of residual liquid detergent D still present in the liquid is considered acceptable. At this purpose, the value of the parameter RinseCount remains unchanged and therefore it is considered that the washing cycle will not need any additional rinsing phase.

It has to be noted that the values of second and third thresholds $\Delta C11$, $\Delta C21$ are opportunely chosen taking into account the fact that the conductivity of the wash liquor comprising powder detergent is higher than the conductivity of the wash liquor comprising liquid detergent. Therefore, the second threshold $\Delta C11$ is higher than the third threshold $\Delta C21$.

In a successive step of the rinse cycle it is checked the value of the parameter RinseCount (block 500).

If the parameter RinseCount is 0 (output "No" of block 500) then it is considered that the first mandatory rinsing phase is enough, and the rinse cycle (block 400) can terminate with a draining phase (block 530) wherein the liquid is drained to the outside by activating the draining pump 27.

Preferably, before the draining phase (block 530) the parameter ZeroConductivity C0 is set with the current measured value of conductivity Cc (block 520). In fact, at this point of the washing cycle, the liquid inside the washing tub 3 may be considered clean, or substantially clean. The parameter ZeroConductivity C0 set herein is then used in the next washing cycle.

Here again, preferably, in order to enhance measurement of the conductivity through the EC meter 54 in a substantially steady state of the liquid, a waiting period (block 510) is preferably introduced before measurement, for example 30 seconds.

Conversely, if the parameter RinseCount is higher than 0 (output "Yes" of block 500) then it is considered that an additional (second) rinsing phase is necessary.

In a successive step, a draining phase is carried out (block 540) wherein the liquid is drained to the outside by activating the draining pump 27. This draining phase (block 540) coincides with the end of the first mandatory rinsing phase.

It follows a water loading (block 550) for starting the additional (second) rinsing phase wherein water is introduced into the washing tub 3.

An optional intermediate spinning phase is preferably carried out (block 560).

The value of the parameter RinseCount is finally decremented by 1 (block 570).

The method then back to the step of checking the RinseCount value (block 500).

Therefore, according to the preferred embodiment of the rinse cycle here described with reference to flow chart FIG. 5 (block 400), the value detected by the EC meter 54, block 440 for powder detergent or block 460 for liquid detergent, is used to eventually perform an additional (second) rinsing phase further to the first mandatory rinsing phase by incrementing by 1 the RinseCount parameter.

In a further preferred embodiment, the method could provide for a greater number of rinsing phases after the first one, preferably by incrementing the RinseCount parameter by a respective value. For example, the RinseCount parameter can be incremented by 3 in block 450 or 470 and the rinsing steps from 540 to 570 are carried out three times accordingly.

Figure 6:
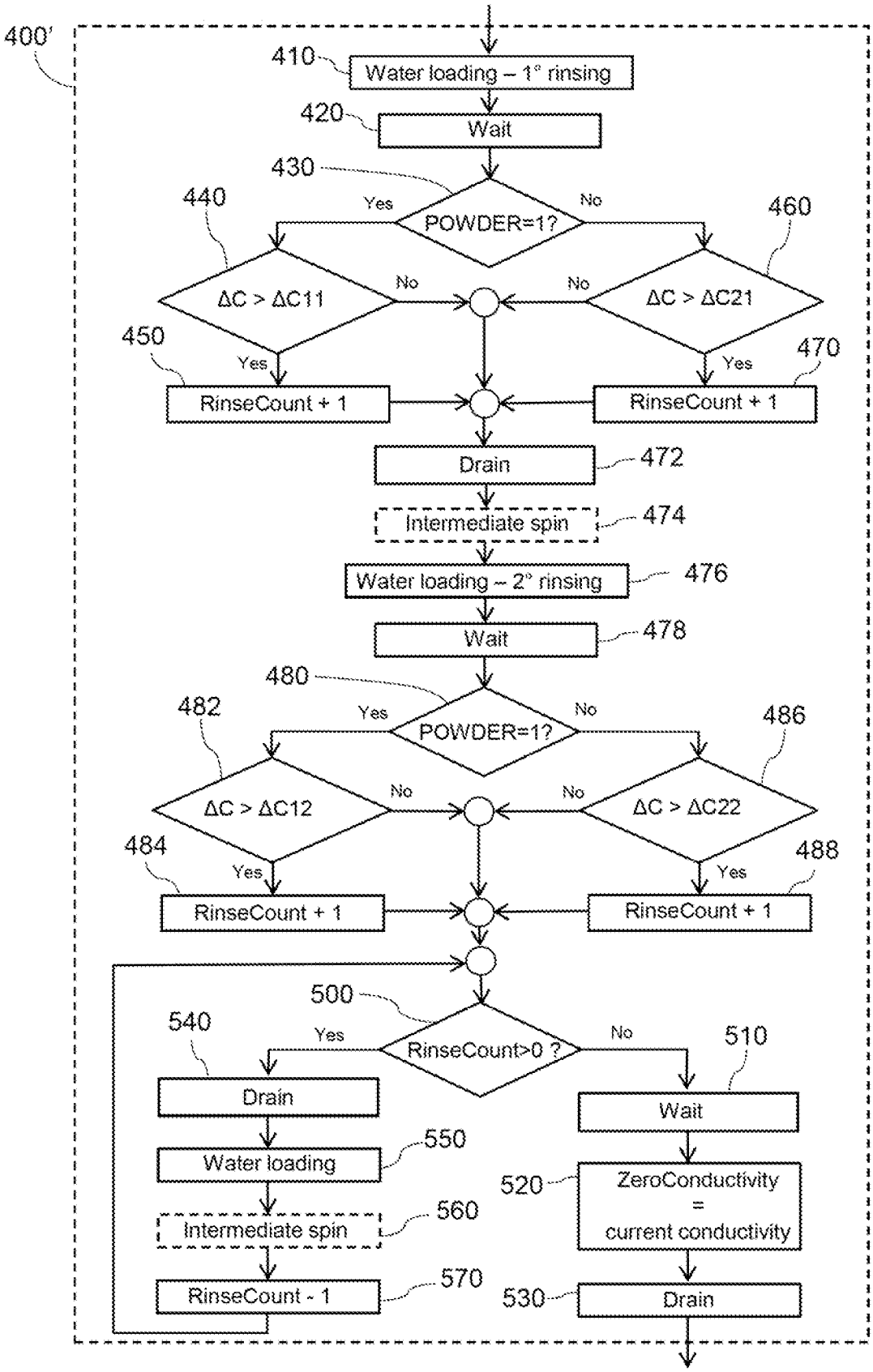
FIG. 6 shows operations of a processing step of the flow chart of FIG. 4 according to a second preferred embodiment of the invention.

FIG. 6 shows a flow chart of a further preferred embodiment of the rinse cycle (block 400') of the washing cycle according to the flow chart of FIG. 4.

In the flow chart of FIG. 6, blocks having the same reference numbers of the flow chart of FIG. 5 identify the same features as previously described.

This embodiment differs from that previously described with reference to FIG. 5 in that the rinse cycle comprises two mandatory rinsing phases, instead of one.

The number of additional rinsing phases after the two mandatory rinsing phases is then evaluated automatically according to the values detected by the EC meter 54. Preferably, the values detected by the EC meter 54 are treated differently if the detergent is a liquid detergent or a powder detergent.

The rinse cycle (block 400') starts with a water loading (block 410) for the first mandatory rinsing phase wherein water is introduced into the washing tub 3.

In a successive step it is checked the type of detergent used (block 430).

Check of the detergent type is carried out by controlling the value of the parameter POWDER previously determined. Namely, if the parameter POWDER is 1 then the detergent is a powder detergent (output "Yes" of block 430) otherwise the detergent is a liquid detergent (output "No" of block 430).

In a different embodiment, check of the detergent type may be analogously carried out by controlling the value of the parameter LIQUID previously determined.

If the detergent is a powder detergent (output "Yes" of block 430), the current measured value of conductivity Cc is compared with the value of ZeroConductivity C0. Preferably, in block 440 the difference ΔC=Cc−C0 between the current measured value of conductivity Cc and the ZeroConductivity value C0 is compared with a predetermined second threshold ΔC11, for example ΔC11=300 μS/cm. As said above, the second threshold ΔC11 is set lower than the first threshold ΔC1.

Preferably, if ΔC is higher than the predetermined second threshold ΔC11 (output "Yes" of block 440) then the amount of residual powder detergent D still present in the liquid is considered too high. For this reason, and according to an aspect of the invention, it is considered that the washing cycle will need at least one additional rinsing phase. At this purpose, the value of a parameter RinseCount is incremented by 1 (block 450).

The parameter RinseCount is set to 0 before the comparing block 440. Preferably, the parameter RinseCount is automatically set to 0 at the beginning of the washing cycle.

If ΔC is not higher than the predetermined second threshold ΔC11 (output "No" of block 440) then the amount of residual powder detergent D still present in the liquid is considered not too high. At this purpose, the value of the parameter RinseCount remains unchanged.

In order to enhance measurement of the conductivity through the EC meter 54 in a substantially steady state of the liquid, a waiting period (block 420) is preferably introduced before measurement, for example 30 seconds.

Analogously, if the detergent is a liquid detergent (output "No" of block 430), the current measured value of conductivity Cc is compared with the value of ZeroConductivity C0. Preferably, in block 460 the difference ΔC=Cc−C0 between the current measured value of conductivity Cc and the ZeroConductivity value C0 is compared with a predetermined third threshold ΔC21, for example ΔC21=20 μS/cm. The third threshold ΔC21 is set lower than the first threshold ΔC1.

Preferably, if ΔC is higher than the predetermined third threshold ΔC21 (output "Yes" of block 460) then the amount of residual liquid detergent D still present in the liquid is considered too high. For this reason, and according to an aspect of the invention, it is considered that the washing cycle will need at least one additional rinsing phase. At this purpose, the value of the parameter RinseCount is incremented by 1 (block 470).

If ΔC is not higher than the predetermined third threshold ΔC21 (output "No" of block 460) then the amount of residual liquid detergent D still present in the liquid is considered not too high. At this purpose, the value of the parameter RinseCount remains unchanged.

It has to be noted that the values of second and third thresholds ΔC11, ΔC21 are opportunely chosen taking into account the fact that the conductivity of the wash liquor comprising powder detergent is higher than the conductivity of the wash liquor comprising liquid detergent. Therefore, the second threshold ΔC11 is higher than the third threshold ΔC21.

In a successive step, a draining phase is carried out (block 472) wherein the liquid is drained to the outside by activating the draining pump 27. This draining phase (block 472) coincides with the end of the first mandatory rinsing phase.

An optional intermediate spinning phase is then preferably carried out (block 474).

It follows a water loading (block 476) for starting the second mandatory rinsing phase wherein water is introduced into the washing tub 3.

In a successive step of the rinse cycle it is checked again the type of detergent used (block 480).

If the detergent is a powder detergent (output "Yes" of block 480), the current measured value of conductivity Cc is compared with the value of ZeroConductivity C0. Preferably, in block 482 the difference ΔC=Cc−C0 between the current measured value of conductivity Cc and the ZeroConductivity value C0 is compared with a predetermined fourth threshold ΔC12, for example ΔC12=40 μS/cm.

The fourth threshold ΔC12 is set lower than the second threshold ΔC11.

Preferably, if ΔC is higher than the predetermined fourth threshold ΔC12 (output "Yes" of block 482) then the amount of residual powder detergent D present in the liquid is still considered too high. For this reason, and according to an aspect of the invention, it is considered that the washing cycle will need at least one additional rinsing phase. At this purpose, the value of the parameter RinseCount is incremented by 1 (block 484).

If ΔC is not higher than the predetermined fourth threshold ΔC12 (output "No" of block 482) then the amount of residual powder detergent D still present in the liquid is considered acceptable. At this purpose, the value of the parameter RinseCount remains unchanged.

In a further preferred embodiment, instead, the value of the parameter RinseCount is set to 0 indicating that no additional rinsing phases are needed.

In order to enhance measurement of the conductivity through the EC meter 54 in a substantially steady state of the liquid, a waiting period (block 478) is preferably introduced before measurement, for example 30 seconds.

Analogously, if the detergent is a liquid detergent (output "No" of block 480), the current measured value of conductivity Cc is compared with the value of ZeroConductivity C0. Preferably, in block 486 the difference ΔC=Cc−C0 between the current measured value of conductivity Cc and the ZeroConductivity value C0 is compared with a predetermined fifth threshold ΔC22, for example ΔC22=5 μS/cm. The fifth threshold ΔC22 is set lower than the third threshold ΔC21.

Preferably, if ΔC is higher than the predetermined fifth threshold ΔC22 (output "Yes" of block 486) then the amount of residual liquid detergent D still present in the liquid is considered too high. For this reason, and according to an aspect of the invention, it is considered that the washing cycle will need at least one additional rinsing phase. At this purpose, the value of the parameter RinseCount is incremented by 1 (block 488).

If ΔC is not higher than the predetermined fifth threshold ΔC22 (output "No" of block 486) then the amount of residual liquid detergent D still present in the liquid is considered acceptable. At this purpose, the value of the parameter RinseCount remains unchanged.

In a further preferred embodiment, instead, the value of the parameter RinseCount is set to 0 indicating that no additional rinsing phases are needed.

In a successive step of the rinse cycle it is checked the value of the parameter RinseCount (block 500).

If the parameter RinseCount is 0 (output "No" of block 500) then it is considered that the two mandatory rinsing phases are enough, and the rinse cycle (block 400') can terminate with a draining phase (block 530) wherein the liquid is drained to the outside by activating the draining pump 27.

Preferably, before the draining phase (block 530) the parameter ZeroConductivity C0 is set with the current measured value of conductivity Cc (block 520). The parameter ZeroConductivity C0 set herein is then used in the next washing cycle.

Here again, preferably, in order to enhance measurement of the conductivity through the EC meter 54 in a substantially steady state of the liquid, a waiting period (block 510) is preferably introduced before measurement, for example 30 seconds.

Conversely, if the parameter RinseCount is higher than 0 (output "Yes" of block 500) then it is considered that a further rinsing phase is necessary.

In a successive step, a draining phase is carried out (block 540) wherein the liquid is drained to the outside by activating the draining pump 27. This draining phase (block 540) coincides with the end of the second mandatory rinsing phase.

It follows a water loading (block 550) for starting the additional (third) rinsing phase wherein water is introduced into the washing tub 3.

An optional intermediate spinning phase is preferably carried out (block 560).

The value of the parameter RinseCount is finally decremented by 1 (block 570).

The method then back to the step of checking the RinseCount value (block 500).

According to the preferred embodiment of the rinse cycle here described with reference to flow chart FIG. 6 (block 400'), the values detected by the EC meter 54, blocks 440 and 482 for powder detergent or blocks 460 and 486 for liquid detergent, are used to eventually perform additional third and/or a fourth rinsing phases further to the two mandatory rinsing phases by incrementing the RinseCount parameter.

Figure 7:
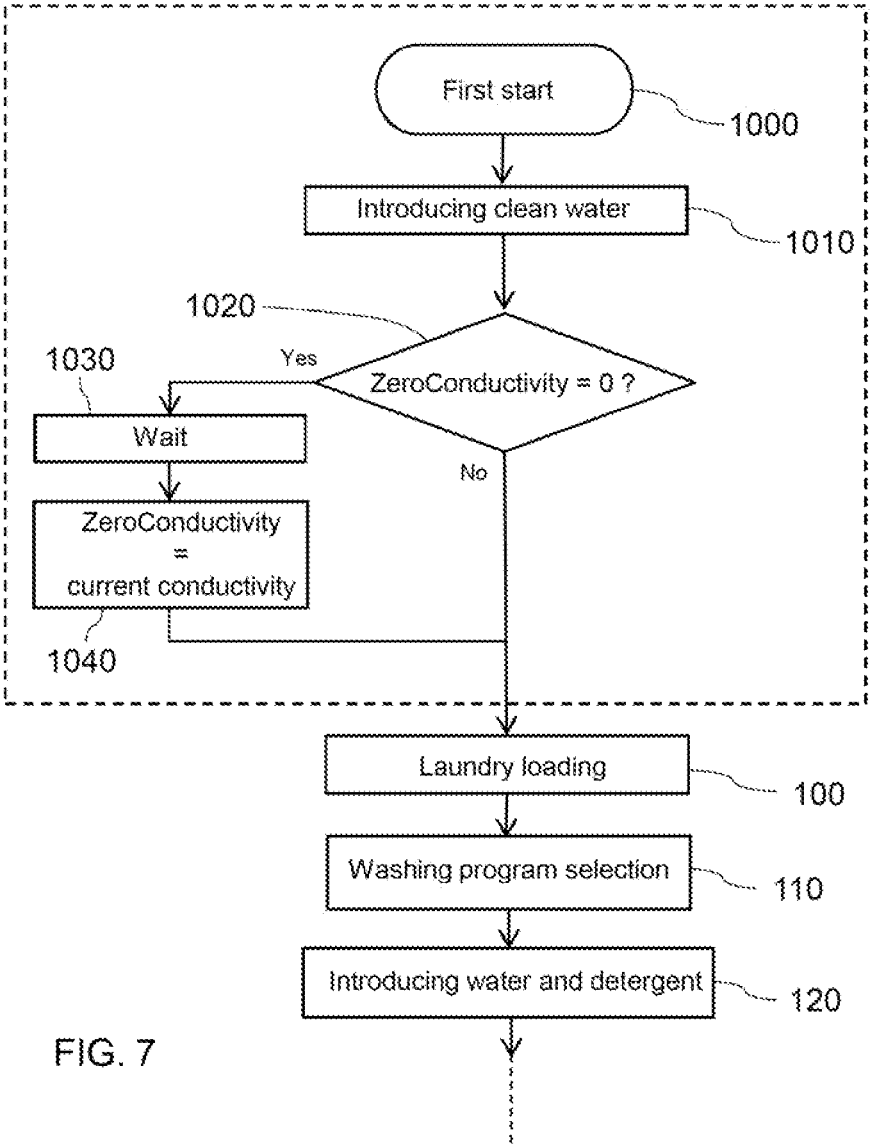
FIG. 7 is a flow chart of some operations of the method for washing laundry in the laundry washing machine of FIG. 1 according to a further preferred embodiment of the invention.

FIG. 7 shows a flow chart of a further preferred embodiment of the washing cycle according to the invention. In particular, the preferred embodiment here illustrated and described allows setting of the parameter ZeroConductivity C0 since the very beginning of the washing cycle. Setting of the parameter ZeroConductivity C0 according to the preferred embodiment preferably comprises preliminary phases carried out the first time the washing machine performs a washing cycle. Preferably, said preliminary phases are carried out at the first washing cycle after installation of the laundry washing machine 1.

As said above, the value of the parameter ZeroConductivity C0 is preferably set when the liquid inside the washing tub 3 may be considered clean, or substantially clean.

In case of first-time installation, the parameter ZeroConductivity C0 is previously set to 0 by the manufacture.

When the washing cycle starts (block 1000), a first amount of clean water is introduced into the washing tub 3 (block 1010).

If the parameter ZeroConductivity C0 is equal to 0 (output "Yes" of block 1020) it is determined that the parameter ZeroConductivity C0 need to be initialized.

The parameter ZeroConductivity C0 is therefore set with the current measured value of conductivity Cc (block 1040).

Preferably, in order to enhance measurement of the conductivity through the EC meter 54 in a substantially steady state of the liquid, a waiting period (block 1030) is preferably introduced before measurement, for example 50 seconds.

The washing cycle then will proceed with the remaining phases, for example phases described with reference to flow chart of FIG. 3 or 4: a laundry loading (block 100), a washing cycle selection (block 110), introduction of detergent and water (block 120), etc.

Conversely, if the parameter ZeroConductivity C0 is different from 0 (output "No" of block 1020) then it is not actually the case of the first washing cycle after installation of the laundry washing machine but it is assumed that the parameter ZeroConductivity C0 has been already set in a previous washing cycle, for example according to phase of block 520 of FIG. 5 or 6.

It has thus been shown that the present invention allows all the set objects to be achieved. In particular, the method according to the invention automatically performs the proper washing cycle according to the soil levels of the laundry.

In the preferred embodiment of the laundry washing machine above described where the method according to the invention is implemented, the sensor unit 50 has been arranged along the recirculation circuit 30, more preferably at the inlet 24 of the recirculation pump 22. Furthermore, the sensor unit 50 is placed downstream of the filtering device 12 so that the liquid is at least partially cleaned.

Nevertheless, in further preferred embodiments, the sensor unit 50 may be arranged in different places, like for example in the sump 15 or at the bottom 3*a* of the washing tub 3, etc.

In the preferred embodiment of the laundry washing machine above described where the method according to the invention is implemented, the recirculation circuit 30 is adapted to drain liquid from the bottom region 3*a* of the washing tub 3 and to re-admit such a liquid into an upper region 3*b* of the washing tub 3.

Nevertheless, in further preferred embodiments, the recirculation circuit may be preferably adapted to drain liquid from the bottom region of the washing tub and to re-admit such a liquid into another region of the washing tub, for example the same bottom region of the washing tub.

Furthermore, as already explained in the description, the laundry washing machine may be even not equipped with any recirculation circuit.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A method for washing laundry in a laundry washing machine comprising:

a washing drum;

a washing tub external to the washing drum configured to receive the laundry to be washed;

a water supply system configured to convey water to the washing tub;

a treating agents dispenser configured to supply at least one treating agent into the washing tub, one of the at least one treating agent comprising a detergent;

a liquid outlet circuit configured to withdraw liquid from a bottom region of the washing tub and drain the liquid to an outside of the tub; and a turbidity detecting device configured to measure a turbidity of the liquid flowing therethrough;

wherein the method comprises:

introducing into the washing tub water and the detergent to soak the laundry;

draining the liquid to the outside of the tub through the liquid outlet circuit;

determining, before the draining step, a soil level of the laundry by means of measurement of turbidity through the turbidity detecting device;

performing at least one soil removal phase, after the draining step, upon determining that the soil level is above a predetermined level; and performing a rinse cycle and a final spinning phase.

2. The method according to claim 1, wherein the soil level is determined to be above the predetermined level upon determining that the measurement of turbidity is lower than a predetermined threshold.

3. The method according to claim 1, further comprising introducing a waiting period before the turbidity measurement so that the liquid is brought in a substantially steady state for the measurement.

4. The method according to claim 1, wherein the at least one soil removal phase comprises introducing water into the washing tub, tumbling the laundry and draining liquid to the outside of the washing tub.

5. The method according to claim 1, wherein the at least one soil removal phase is carried out only if the detergent is a liquid detergent.

6. The method according to claim 1, further comprising determining if the detergent is a liquid detergent or a powder detergent.

7. The method according to claim 6, wherein determining if the detergent is the liquid detergent or the powder detergent is based on measurement carried out through an electrical conductivity detecting device.

8. The method according to claim 6, wherein determining if the detergent is the liquid detergent or the powder detergent comprises calculating a difference between a current measured value of conductivity of the liquid containing the detergent and a conductivity reference value which refers to a conductivity of clean water, or substantially clean water, and comparing the difference with a predetermined first threshold.

9. The method according to claim 8, wherein, if the difference is not higher than the predetermined first threshold the detergent is considered to be the liquid detergent.

10. The method according to claim 6, wherein determining if the detergent is the liquid detergent or the powder detergent comprises comparing directly a current measured value of conductivity of the liquid containing the detergent with a predetermined first threshold.

11. The method according to claim 10, wherein if the current measured value of conductivity is not higher than the predetermined first threshold the detergent is considered to be the liquid detergent.

12. The method according to claim 1, wherein the laundry washing machine further comprises a recirculation circuit configured to drain liquid from the bottom of the washing tub and to re-admit such liquid into a first region of the washing tub and the method further comprises recirculating the liquid from the bottom of the washing tub and re-admitting such liquid into the first region of the washing tub through the recirculation circuit.

13. The method according to claim 12, wherein the turbidity detecting device is arranged along the recirculation circuit.

14. The method according to claim 7, wherein:

the laundry washing machine further comprises a recirculation circuit configured to drain liquid from the bottom of the washing tub and to re-admit such liquid into a first region of the washing tub and the method further comprises recirculating the liquid from the bottom of the washing tub and re-admitting such liquid into the first region of the washing tub through the recirculation circuit; and the electrical conductivity detecting device is arranged along the recirculation circuit.

15. A laundry washing machine comprising:

a washing drum;

a washing tub external to the washing drum configured to receive the laundry to be washed;

a water supply system configured to convey water to the washing tub;

a treating agents dispenser configured to supply at least one treating agent into the washing tub, one of the at least one treating agent comprising a detergent;

a liquid outlet circuit configured to withdraw liquid from a bottom region of the washing tub and drain the liquid to an outside of the tub;

a turbidity detecting device configured to measure a turbidity of the liquid flowing therethrough; and a control unit configured to:

operate the water supply system to introduce into the washing tub water and the detergent to soak the laundry;

operate the turbidity detecting device to determine a soil level of the soaked laundry by means of measurement of turbidity through the turbidity detecting device;

after determining the soil level, operate the liquid outlet circuit to drain the liquid to the outside of the tub through the liquid outlet circuit;

perform at least one soil removal phase, after the draining step, upon determining that the soil level is above a predetermined level; and operate the water supply system and the washing drum to perform a rinse cycle and a final spinning phase.

16. The laundry washing machine of claim 15, wherein the control unit is configured to determine if the detergent is a liquid detergent or a powder detergent.

17. The laundry washing machine of claim 16, wherein determining if the detergent is the liquid detergent or the powder detergent is based on measurement carried out through an electrical conductivity detecting device.

18. The laundry washing machine of claim 15, wherein the at least one soil removal phase is carried out only if the detergent is a liquid detergent.

19. The laundry washing machine of claim 15, wherein prior to determining the soil level, the liquid is brought in a substantially steady state.

20. The laundry washing machine of claim 15, further comprising a recirculation circuit configured to drain liquid from the bottom of the washing tub and to re-admit such liquid into a first region of the washing tub, wherein the turbidity detecting device is arranged along the recirculation circuit.

* * * * *